US006257968B1

(12) United States Patent
Carey et al.

(10) Patent No.: US 6,257,968 B1
(45) Date of Patent: Jul. 10, 2001

(54) QUICK-RELEASE LENS CLAMP PAD ASSEMBLY FOR USE IN EYEGLASS LENS PROCESSING

(75) Inventors: Joseph J. Carey, Charlottesville; Steven F. Hovanic, Gordonsville; Ivy G. Haney, Charlottesville, all of VA (US)

(73) Assignee: National Optronics, Incorporated, Charlottesville, VA (US)

( * ) Notice: Subject to any disclaimer, the term of this patent is extended or adjusted under 35 U.S.C. 154(b) by 0 days.

(21) Appl. No.: 09/265,857

(22) Filed: Mar. 11, 1999

Related U.S. Application Data

(60) Provisional application No. 60/112,568, filed on Dec. 16, 1998.

(51) Int. Cl.[7] ..... B24B 1/00

(52) U.S. Cl. ..... 451/354; 451/398

(58) Field of Search ..... 451/384, 388, 451/390, 398, 402, 42, 354

(56) References Cited

U.S. PATENT DOCUMENTS

| | | | | |
|---|---|---|---|---|
| 659,778 | | 10/1900 | Weaver . | |
| 912,518 | | 2/1909 | Wilhelm . | |
| 1,002,124 | | 8/1911 | Borresen . | |
| 1,184,496 | | 5/1916 | Stenvall . | |
| 1,436,156 | * | 11/1922 | Drescher | 451/384 |
| 1,721,161 | | 7/1929 | Maynard . | |
| 2,209,605 | | 7/1940 | Maynard | 51/101 |
| 2,441,472 | * | 5/1948 | D'avaucourt | 451/390 X |
| 2,573,668 | | 10/1951 | Long et al. | 51/277 |
| 2,748,541 | | 6/1956 | Connell | 51/101 |
| 3,410,031 | | 11/1968 | Soong | 51/237 |
| 3,631,637 | * | 1/1972 | Tagnon | 451/398 X |
| 3,704,554 | * | 12/1972 | Laughman | 451/390 X |
| 3,877,182 | * | 4/1975 | Godot | 451/398 X |
| 4,561,213 | | 12/1985 | Tusinski et al. | 51/105 |
| 4,562,671 | | 1/1986 | Bouillon et al. | 51/216 |
| 4,653,234 | | 3/1987 | Lombard | 51/216 |
| 4,669,226 | * | 6/1987 | Mandler | 451/390 X |
| 4,941,291 | | 7/1990 | Brueck | 51/105 |
| 4,951,421 | | 8/1990 | Brueck | 51/105 |
| 4,993,195 | | 2/1991 | Gray | 51/285 |
| 5,005,633 | * | 4/1991 | Mathews et al. | 451/390 X |
| 5,158,422 | | 10/1992 | Wagner | 409/84 |
| 5,283,980 | | 2/1994 | Lohrenz et al. | 51/165.72 |
| 5,341,604 | | 8/1994 | Wood | 51/165.71 |
| 5,421,770 | * | 6/1995 | Bobst | 451/390 |

(List continued on next page.)

*Primary Examiner*—Joseph J. Hail, III
*Assistant Examiner*—Anthony Ojini
(74) *Attorney, Agent, or Firm*—Liniak, Berenato, Longacre & White, LLC

(57) ABSTRACT

A lens pad is provided for use on a lens clamp. The lens pad comprises a lens-engaging surface which, in turn, has a lens-facing recess located substantially centrally thereon. The lens-engaging surface thus is annular. Alternatively, the lens-engaging surface is more resilient toward a center thereof than toward a periphery thereof. Forces exerted by the lens pad against a surface of a lens when the lens pad is pressed against the surface therefore are less concentrated than such forces would be if the lens-engaging surface had no recess or variation in resiliency. Also provided is a clamp pad assembly. The clamp pad assembly includes a lens pad and a rotatable body for rotatably connecting the lens pad, at least indirectly, to a clamp arm. The clamp pad assembly also may include a swivel member which is pivotally mounted to the rotatable body for rotation therewith and for pivoting with respect thereto, in which case, the lens pad is mounted to the swivel member for rotation and pivoting therewith. The clamp pad assembly also may include a quick-release system capable of frictionally connecting the rotatable body to the clamp arm. The quick-release system permits quick removal and replacement of the clamp pad assembly for purposes of repair, changing lens pad configurations, changing lens pad sizes, and the like.

34 Claims, 5 Drawing Sheets

U.S. PATENT DOCUMENTS

| | | | | |
|---|---|---|---|---|
| 5,421,771 | * | 6/1995 | Wardle | 451/390 |
| 5,567,198 | | 10/1996 | Cook | 451/384 |
| 5,611,252 | | 3/1997 | Hattori et al. | 82/165 |
| 5,649,856 | | 7/1997 | Cook | 451/460 |
| 5,695,395 | | 12/1997 | Granziera | 451/390 |
| 5,746,436 | | 5/1998 | Kulan et al. | 279/4.04 |
| 5,763,075 | | 6/1998 | Benjamin et al. | 428/349 |
| 5,785,580 | | 7/1998 | Cook | 451/42 |

* cited by examiner

QUICK-RELEASE LENS CLAMP PAD ASSEMBLY FOR USE IN EYEGLASS LENS PROCESSING

This is a Non-Provisional Application of Provisional Application Ser. No. 60/112,568 filed on Dec. 16, 1998, and entitled Quick-Release Lens Clamp Pad Assembly for Use in Eyeglass Lens Processing.

BACKGROUND OF THE INVENTION

The present invention relates to a quick-release lens clamp pad assembly for use in eyeglass lens processing. The quick-release clamp pad assembly is particularly useful in the context of lens edging, although it is understood that the invention is not limited to that particular context.

Eyeglass lenses which carry anti-reflective coatings are becoming increasingly popular. In the past, however, when such lenses have been subjected to processing (e.g., during edging for purposes of adapting the lenses to a particular eyeglass frame or during other processing where the lens is held by its center), there has been a tendency to crack, craze or otherwise deteriorate the anti-reflective coating. Such deterioration has been found to occur as a result of the pressure exerted on the coating(s) when such lenses are clamped at their respective centers. There is consequently a need in the art for a lens clamp capable of holding lenses for edge or near-edge processing, which clamp also avoids or at least reduces the possibility of damage to anti-reflective coatings.

Another recent trend in the eyeglass industry is for the lenses of eyeglasses to be smaller in diameter. The latter trend is based at least partially on recent changes in fashion. While some people accept such changes in fashion, others resist. There is consequently a need for lens processing devices which are easily adaptable to avoid damage to anti-reflective coatings and which also are adaptable to processing of lenses of various diameters, including the types of lenses which are referred to in the eyeglass industry as "half-eye" lenses.

There also is a need in the art for a lens clamp pad assembly which can be used to secure a lens in place, and which also provides quick-release capabilities, whereby the lens clamp pad assembly can be easily replaced with an identical, a similar, or a different lens clamp pad assembly.

SUMMARY OF THE INVENTION

A primary object of the present invention is to provide a lens clamp capable of holding lenses for edge or near-edge processing, which clamp also avoids or at least reduces the possibility of damage to anti-reflective coatings.

Another object of the present invention is to provide a lens clamp which easily adapts a lens processing device to avoid damage to anti-reflective coatings and which also adapts the lens processing device for processing of lenses of various diameters, including the types of lenses which are referred to in the eyeglass industry as "half-eye" lenses.

Still another object of the present invention is to provide a lens clamp pad assembly which can be used to secure a lens in place, and which also provides quick-release capabilities, whereby the lens clamp pad assembly can be easily replaced with an identical, a similar, or a different lens clamp pad assembly.

To achieve these and other objects, the present invention provides a lens pad for use on a lens clamp. The lens pad comprises a lens-engaging surface. The lens-engaging surface has a lens-facing recess located substantially centrally on the lens-engaging surface, whereby the lens-engaging surface is annular.

The present invention also provides a lens pad for use on a lens clamp, wherein the lens pad comprises a lens-engaging surface which is more resilient toward a center thereof than toward a periphery thereof. Forces exerted by the lens pad against a surface of a lens when the lens pad is pressed against the surface therefore are less concentrated than such forces would be if the lens-engaging surface had no variation in resiliency.

Also provided by the present invention is a clamp pad assembly. The clamp pad assembly includes a lens pad and a rotatable body for rotatably connecting the lens pad, at least indirectly, to a clamp arm. The lens pad comprises a lens-engaging surface. The lens-engaging surface has a lens-facing recess located substantially centrally on the lens-engaging surface, whereby the lens-engaging surface is annular.

The present invention also provides a clamp pad assembly having a lens pad and a rotatable body for rotatably connecting the lens pad, at least indirectly, to a clamp arm, wherein the lens pad comprises a lens-engaging surface which is more resilient toward a center thereof than toward a periphery thereof. Forces exerted by the lens pad against a surface of a lens when the lens pad is pressed against the surface therefore are less concentrated than such forces would be if the lens-engaging surface had no variation in resiliency.

Also provided by the present invention is a clamp pad assembly comprising a lens pad, a rotatable body, and a swivel member. The rotatable body is for rotatably connecting the lens pad, at least indirectly, to a clamp arm. The swivel member is pivotally mounted to the rotatable body for rotation therewith and for pivoting with respect thereto. The lens pad is mounted to the swivel member for rotation and pivoting therewith.

The present invention also provides a clamp pad assembly comprising a lens pad, a rotatable body, and a quick-release system. The rotatable body is for rotatably connecting the lens pad, at least indirectly, to a clamp arm. The quick-release system is capable of frictionally connecting the rotatable body to the clamp arm.

Also provided by the present invention is a clamp pad assembly comprising a shaft, an O-ring in each of at least one O-ring groove of the shaft, a bearing, a rotatable body, a swivel member, and a lens pad. The shaft has first and second portions spaced longitudinally along the shaft. The first portion has at least one circumferential O-ring groove. An O-ring(s) is (are) provided in the O-ring groove(s), the O-ring(s) being resilient so that insertion of the first portion into a clamp arm opening causes compression of the O-ring (s) and over-ridable frictional retention of the first portion of the shaft in the opening of the clamp arm. The bearing is located against the second portion of the shaft. The rotatable body is mounted to the bearing for rotation with respect to the shaft. The swivel member is pivotally mounted to the rotatable body for rotation therewith and for pivoting with respect thereto. The lens pad is mounted to the swivel member for rotation and pivoting with the swivel member.

The above and other objects and advantages will become more readily apparent when reference is made to the following description taken in conjunction with the accompanying drawings.

DESCRIPTION OF THE PREFERRED EMBODIMENTS

The present invention will be described hereinafter in the exemplary context of an edging apparatus (e.g., an apparatus which provides edging of a lens for purposes of adapting the lens to a particular eyeglass frame). An exemplary edger is shown in Wagner, U.S. Pat. No. 5,158,422, assigned to the assignee hereof, the disclosure of which is incorporated herein by reference. It is understood, however, that the invention is not limited to use in connection with an edging apparatus.

Figure 1:
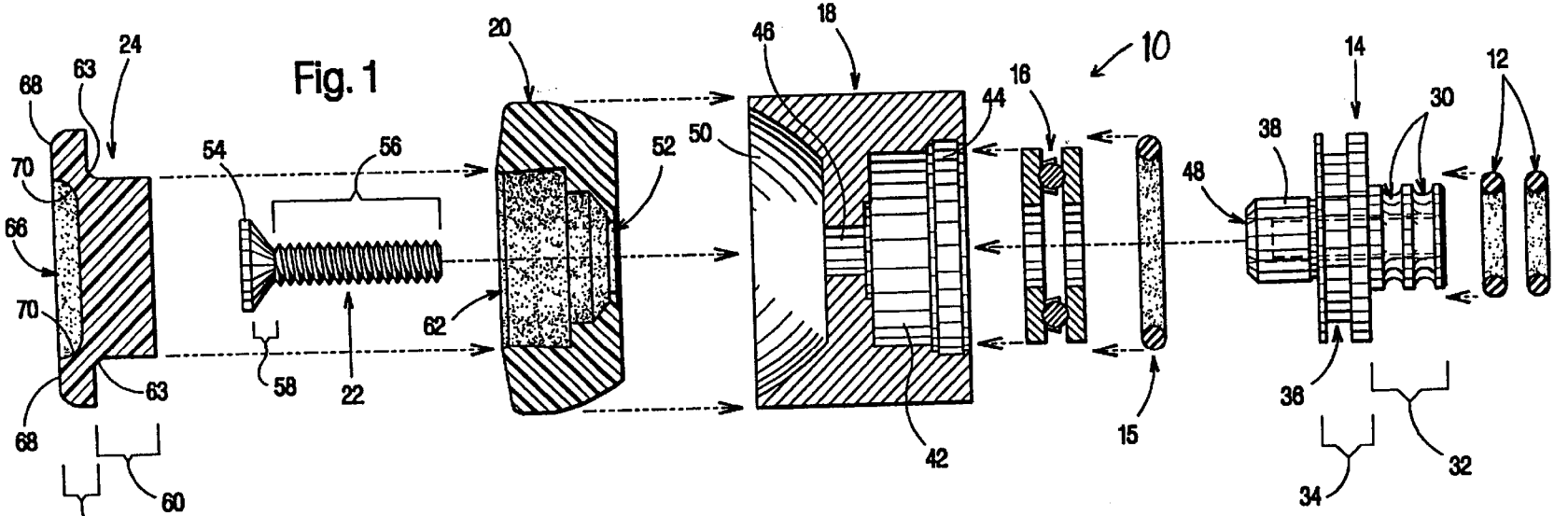
FIG. 1 is an exploded cross-sectional view of clamp pad assembly according to a preferred embodiment of the present invention.

FIG. 1 is an exploded cross-sectional view of a clamp pad assembly 10 according to a preferred embodiment of the present invention. The clamp pad assembly 10 includes two O-rings 12, a shaft 14, an O-ring 15 which is, in diameter, larger than the O-rings 12, a thrust bearing 16, a rotatable body 18, a swivel member 20, a fastener 22, and a counterbored pad 24.

The O-rings 12 and 14 preferably are made of rubber, synthetic rubber, or any other suitably resilient material. The shaft 14 and rotatable body 18 preferably are made of stainless steel or the like. The swivel member 20 preferably is made of brass or the like, and the counterbored pad 24 preferably is made of rubber, synthetic rubber, or any other suitably resilient material. While the foregoing materials are preferred, it is understood that the invention is not limited to embodiments which use any or all of the foregoing exemplary materials.

Figure 2:
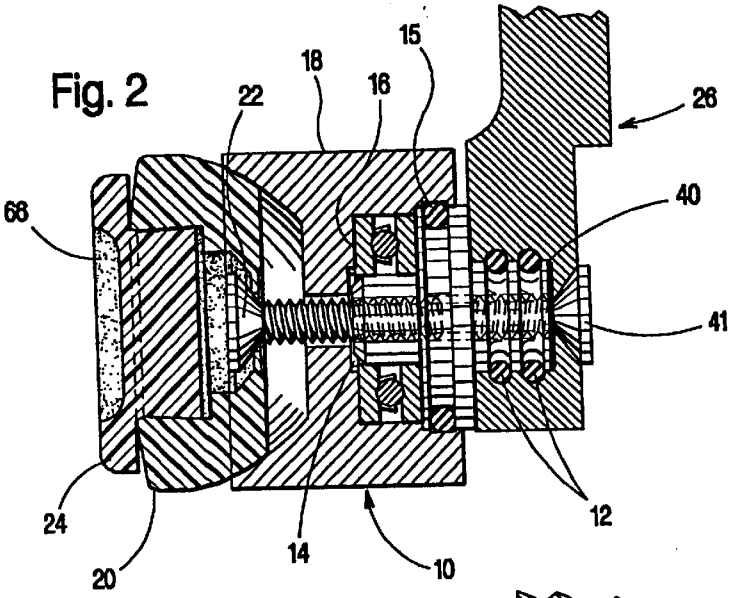
FIG. 2 is a cross-sectional view of the assembled clamp pad assembly shown in FIG. 1, when mounted on a first preferred clamp of an edging apparatus.

FIG. 2 is a cross-sectional view of the assembled clamp pad assembly 10. In FIG. 2, the clamp pad assembly 10 is shown mounted on a first preferred clamp arm 26 of an edging apparatus. While the entire edging apparatus is not shown, such edging apparatuses are known. One example of such a lens edging apparatus is disclosed in U.S. Pat. No. 5,158,422, the contents of which are incorporated herein by reference, with the clamp arm 216 therein corresponding to the clamp arm 26 hereof.

During an edging operation, the lens, which is to be subjected to the edging operation, is rotatably held between two clamping members. The clamp pad assembly 10 and the clamp arm 26 can be used advantageously to define one of the clamping members. The clamp pad assembly 10 and clamp arm 26 preferably define the clamping member which is axially movable to selectively release or secure the lens in place. The clamp pad assembly 10 is provided on the axially movable clamping member to avoid damage to the lens when the lens is clamped in place.

As shown in FIG. 2, the O-rings 12 circumferentially surround the shaft 14. Recesses 30 are provided in the shaft 14 to accommodate the O-rings 12, as best shown in FIG. 1. The shaft 14 has a portion 32 of smaller diameter than a portion 34. The O-rings 12 are mounted about the portion 32 of smaller diameter.

The portion 34 of larger diameter is where the larger O-ring 15 is mounted. The larger O-ring 15 is accommodated in a suitably dimensioned recess 36 which circumferentially surrounds the region 34 of the shaft 14.

As shown in FIG. 2, the portion 32 of smaller diameter fits snugly into a hole 40 in the clamp arm 26. When the portion 32 is pressed into the hole 40, the O-rings 12 are compressed and provide a press-fit retention effect, which keeps the clamp pad assembly 10 secured to the arm 26. Notably, this press-fit retention effect can be manually or otherwise overcome by pulling axially on the clamp pad assembly 10. A quick-release arrangement therefore is achieved. The clamp pad assembly 10 can be secured easily to the arm 26 by merely pressing the portion 32 into the hole 40, and can be removed easily from the arm 26 by merely pulling on the assembly 10 until the portion 32 slides out from the hole 40. Such a quick-release arrangement advantageously facilitates rapid removal, servicing, repair and/or replacement of the clamp pad assembly 10. The replacement advantageously can be performed using an identical assembly 10, a reconditioned assembly 10, a different assembly 10 (e.g., different in size, shape, or otherwise), or a new assembly 10 which is the same as the replaced assembly was when new.

If it becomes desirable to forego the quick-release arrangement, a second fastener 41 (e.g., a #6-32 FHSC screw which is 0.375 inch long) can be inserted through a suitable opening in the arm 26 and can be threadedly received by the shaft 14, as best shown in FIG. 2. The illustrated embodiment therefore is easily adaptable to the particular needs of each user.

The shaft 14 also includes a race 38 about which the thrust bearing 16 is mounted. The thrust bearing 16 provides an interface between the shaft 14 and the rotatable body 18, which permits rotation of the rotatable body 18 with respect to the rotationally stationary shaft 14. In particular, the thrust bearing 16 and the race 38 are accommodated in a thrust bearing pocket 42 of the rotatable body 18. A pocket 44 of larger diameter than the pocket 42 also is provided in the rotatable body 18. The pocket 44 of larger diameter accommodates the portion 34 of larger diameter and the O-ring 15. The rotatable body 18 also includes a through-hole 46 which allows the fastener 22 to pass through the rotatable body 18 and to be threadedly received by an internally threaded bore 48 of the shaft 14.

The rotatable body 18 further includes a swivel pocket 50. The swivel pocket 50 accommodates a similarly shaped portion of the swivel member 20. The swivel member 20 rotates with the rotatable body 18 when the rotatable body 18 rotates. A through-hole 52 is provided in the swivel member 20. The fastener 22 passes through the through-hole 52, and after passing through the through-hole 46 of the rotatable body 18, the fastener 22 threadedly engages the shaft 14. Preferably, the fastener 22 is threadedly engaged into the shaft 14 and then is rotated out (or loosened) by about one full turn to permit swiveling of the swivel member 20. A thread-locking compound (or tape) may be used to keep the fastener 22 from further loosening. One example of such a thread-locking compound is commercially available under the trademark "LOC-TITE". The swiveling provided by the swivel member 20 advantageously compensates for variations in the curvature of a lens (e.g., any angularity induced by prism). Compensation for asymmetric lenses is thereby provided.

Preferably, the fastener 22 has a flat head 54, a shank 56, and a shoulder 58 between the head 54 and the shank 56. The shoulder 58 preferably has a diameter which progressively increases from the shank 56 to the head 54.

After the fastener 22 is secured in place, the counterbored pad 24 is applied to the swivel member 20. In particular, the counterbored pad 24 has a shank 60 which is accommodated and frictionally retained in a pad recess 62 of the swivel member 20. A shoulder 63 of the counterbored pad 24 provides a transition to a head 64 of the pad 24. The head 64 is hollowed out to form a lens-center-facing circular recess 66. The lens-center-facing recess 66 advantageously distributes pressing forces over a greater surface area than would be case without the recess 66. In particular, pressing of the clamp pad assembly 10 against a suitably positioned lens causes the majority of the pressing forces to be applied over the larger surface area defined by the annular lens-engaging surface 68 of the pad 24. The force per unit of surface area therefore is reduced because of the larger distribution of pressing forces. The larger distribution of pressing forces thereby serves to reduce or eliminate the detrimental effects on the lens and its coatings which might otherwise occur as a result of more concentrated pressing forces.

The advantages of the present recess 66 are realized regardless of whether the pad 24 is applied against a concave, convex, or substantially flat surface of a lens. In situations where an annular lens block is adhesively attached to the opposite surface of the lens, the recess 66 advantagously causes the pad 24 to push the lens more directly against the block, with the pressing force distributed over a greater surface area.

While a counterbored pad 24 is shown as the exemplary way of achieving the larger distribution of pressing forces, it is understood that similar results can be achieved using, for example, a composite lens engaging surface of discretely or progressively increasing rigidity toward radially outer portions of the lens engaging surface. The present invention thus is not limited to the illustrated embodiment.

Advantageously, the frictional retention of the counterbored pad 24 in the swivel member 20 facilitates replacement and/or repair of the pad 24. When the pad 24 wears out, for example, the pad 24 is pulled out from the swivel member 20 and is easily replaced or repaired. Since the clamp pad assembly 10 preferably is secured to the arm 26 using a quick-release arrangement, the replacement and/or repair of the pad 24 can be achieved quickly and easily by either pulling out the pad 24 alone or, if desired, by pulling out the entire clamp pad assembly 10 and removing the pad 24 after removal of the entire clamp pad assembly 10. The versatility provided by the illustrated arrangement represents yet another advantage of the present invention.

Of course, if replacement of the entire assembly 10 is more desirable than replacement of the pad 24 alone, it is understood that the pad 24 can be secured permanently to the swivel member 18. Typically, however, the ability to remove the pad 24 will be preferred.

Figure 3:
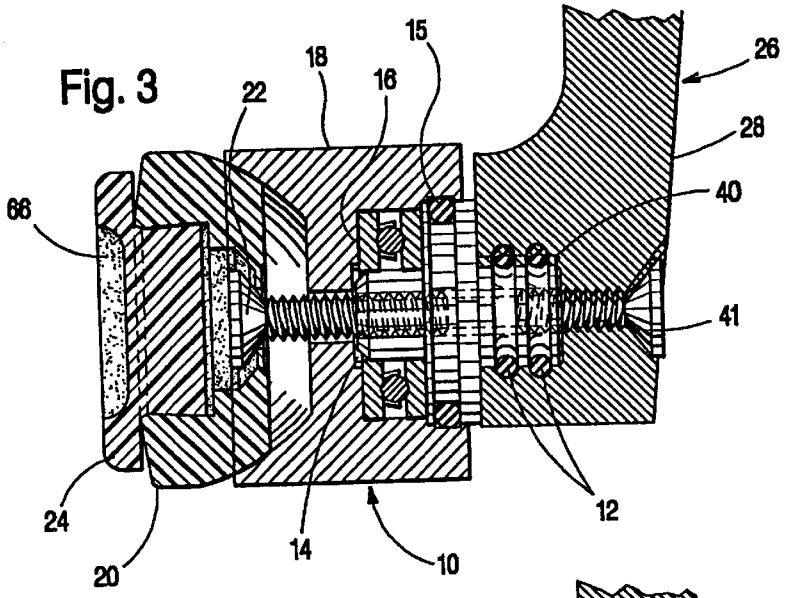
FIG. 3 is a cross-sectional view of the assembled clamp pad assembly shown in FIG. 1, when mounted on a second preferred clamp of an edging apparatus.

FIG. 3 is a cross-sectional view of the assembled clamp pad assembly 10 shown in FIG. 1, when mounted on a second preferred clamp of an edging apparatus. In the second preferred clamp, the clamp arm 26 has an angled back side 28.

Figure 4:
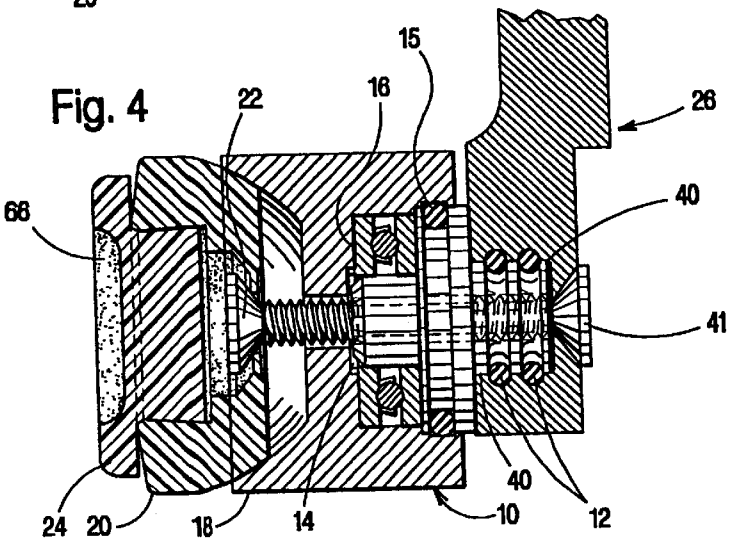
FIG. 4 is a cross-sectional view of an alternative embodiment of the clamp pad assembly shown in FIG. 2, when mounted on the first preferred clamp shown in FIG. 2.

FIG. 4 is a cross-sectional view of an alternative embodiment of the clamp pad assembly shown in FIG. 2, when mounted on the first preferred clamp shown in FIG. 2. In the illustrated alternative embodiment, the fastener 22 is shorter and therefore does not extend into the shaft 14. In FIG. 2, the fastener 22 (e.g., a #6-32 FHSC screw) is about 0.625 inch long, whereas in FIG. 4, the fastener 22 is about 0.375 inch long. The fastener 22 shown in FIG. 4, therefore, is not threadedly received by the shaft 14, but rather is threadedly received by the clamp body 18. The O-ring 15 thus is primarily responsible for holding the assembly 10 together in the embodiment of FIG. 4.

Figure 5:
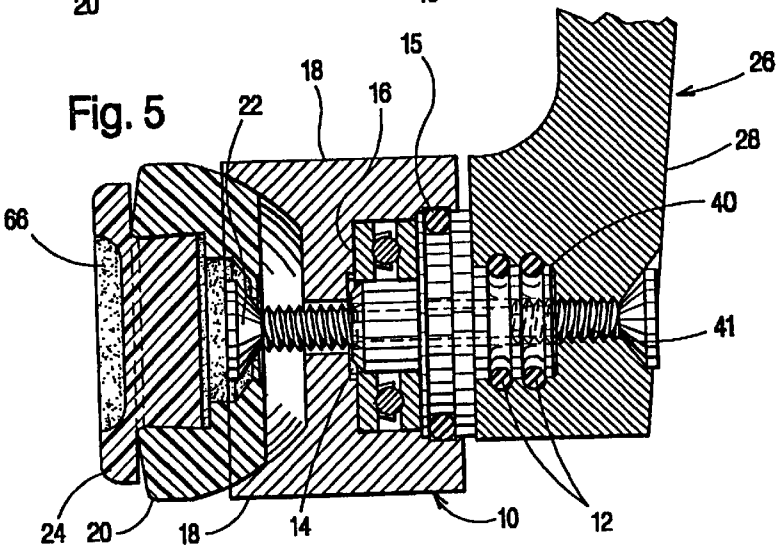
FIG. 5 is a cross-sectional view of the alternative embodiment shown in FIG. 4, when mounted on the second preferred clamp shown in FIG. 3.

Otherwise, the components which make up the assembly 10 in FIG. 4 are substantially the same as their counterparts in FIG. 2. FIG. 5 is a cross-sectional view of the alternative embodiment shown in FIG. 4, when mounted on the second preferred clamp shown in FIG. 3. Notably, the clamp arm 26 has an angled back side 28.

Figure 6:
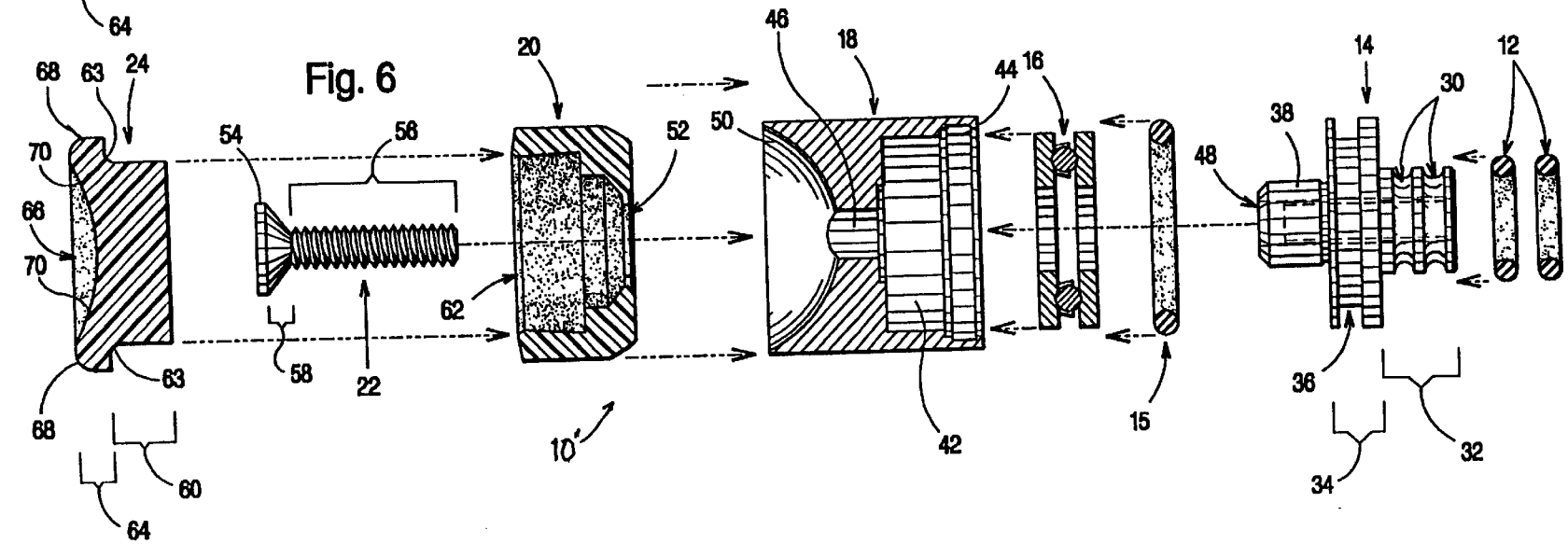
FIG. 6 is an exploded cross-sectional view of a clamp pad assembly according to a second embodiment of the present invention.

FIG. 6 is an exploded cross-sectional view of a clamp pad assembly 10' according to a second embodiment of the present invention. This second embodiment shares many similar components to its counterpart shown in FIG. 1. The second embodiment differs, however, in that it is adapted for use on lenses (e.g., half-eye lenses) having smaller dimensions, especially smaller diametric dimensions (or lenses which are to be cut or edged to have smaller diametric dimensions). The counterbored pad 24 in FIG. 6 therefore has a smaller diameter than that which appears in FIG. 1. A smaller lens engaging surface 68 therefore is presented. Though the distribution of pressing forces tends to not be as large in the embodiment of FIG. 6 as that of the assembly 10 shown in FIG. 1, it nevertheless represents an improvement over the centrally concentrated pressing forces which result from other pad arrangements.

To compensate for the decrease in force distribution and the consequent increase in force per unit length around the annular lens-engaging surface 68, when compared to the embodiment shown in FIG. 1, the embodiment shown in FIG. 6 has a pad 24 with an increased thickness between the shoulder 63 and the wall 70 of the recess 66. This increased thickness eliminates (or at least significantly reduces) the likelihood of failure (e.g., cracking) in response to the decreased force distribution. Of course, it is understood that the invention is not limited to this exemplary way of compensating for the decreases and increases in force distribution associated with the different sizes of pads 24. Such compensation also can be achieved by using different materials, reinforcement, and the like.

Figure 7:
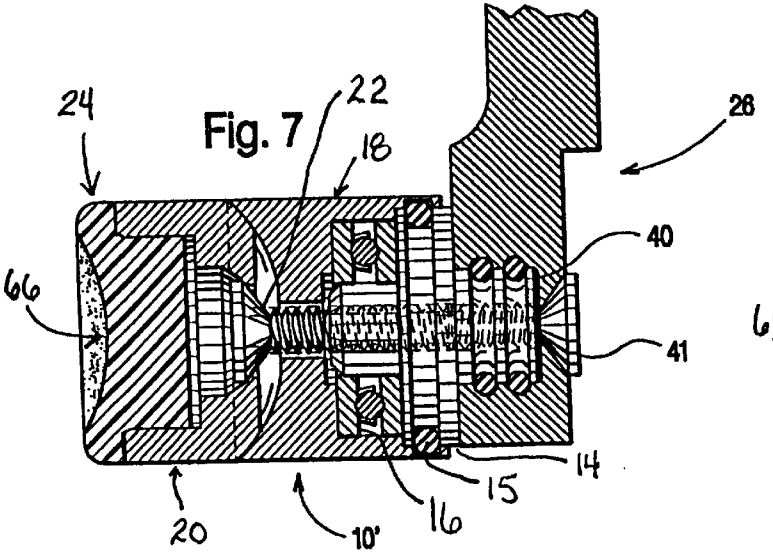
FIG. 7 is a cross-sectional view of the assembled clamp pad assembly shown in FIG. 6, when mounted on the first preferred clamp of an edging apparatus.

FIG. 7 is a cross-sectional view of the assembled clamp pad assembly 10' shown in FIG. 6, when mounted on the first preferred clamp of an edging apparatus. The clamp arm 26 is again designated using reference numeral 26. Notably, the quick-release arrangement provided by the shaft 14, O-rings 12, and the arm 26 facilitates switching of the clamp pad assembly 10' for the assembly 10 and vice versa.

Figure 8:
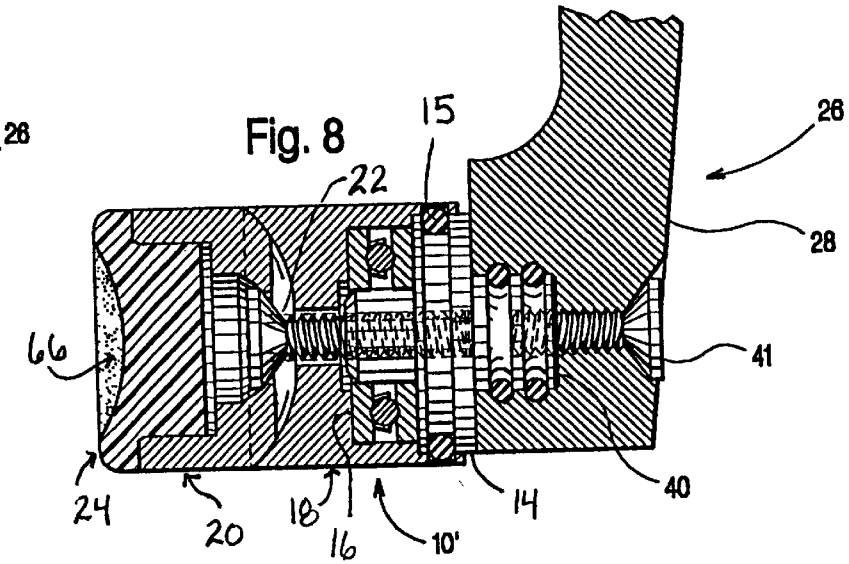
FIG. 8 is a cross-sectional view of the assembled clamp pad assembly shown in FIG. 6, when mounted on a second preferred clamp of an edging apparatus.

FIG. 8 is a cross-sectional view of the assembled clamp pad assembly 10' shown in FIG. 6, when mounted on the second preferred clamp of an edging apparatus. Notably, the angled back side 28 is present.

Figure 10:
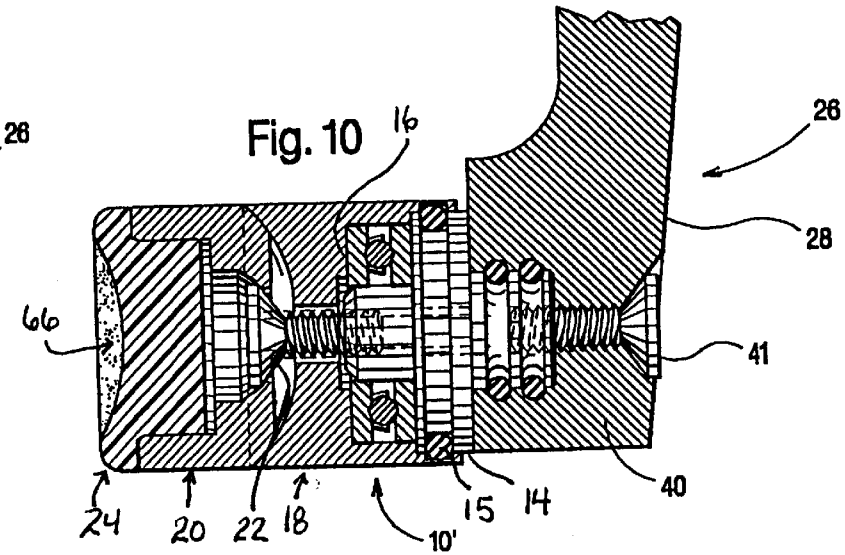
FIG. 10 is a cross-sectional view of the alternative embodiment shown in FIG. 9, when mounted on the second preferred clamp shown in FIG. 8.
Figure 9:
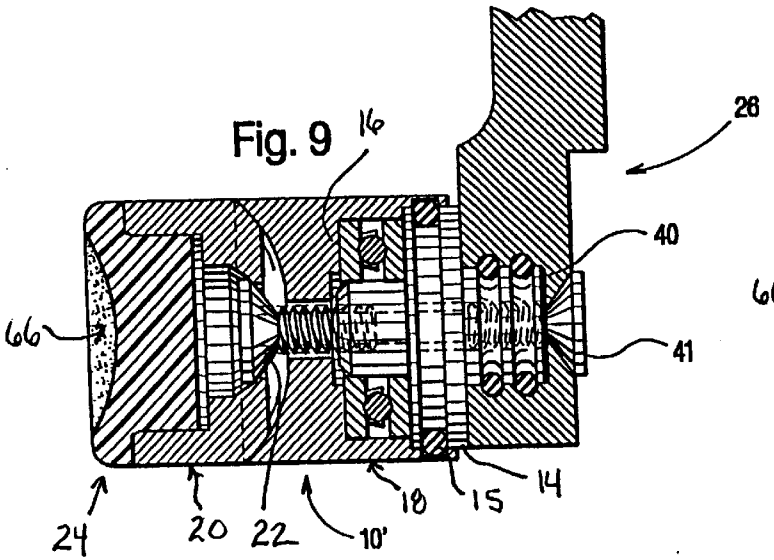
FIG. 9 is a cross-sectional view of an alternative embodiment of the clamp pad assembly shown in FIG. 7, when mounted on the first preferred clamp shown in FIG. 7.

FIG. 9 is a cross-sectional view of an alternative embodiment of the clamp pad assembly shown in FIG. 7, when mounted on the first preferred clamp shown in FIG. 7. In the illustrated alternative embodiment, the primary difference from the embodiment illustrated in FIG. 7 is that the fastener 22 is shorter and therefore does not extend as far into the shaft 14. Otherwise, the components which make up the assembly 10' in FIG. 9 are substantially the same as their counterparts in FIG. 7. FIG. 10 is a cross-sectional view of the alternative embodiment shown in FIG. 9, when mounted on the second preferred clamp shown in FIG. 8. Notably, the clamp arm 26 has the angled back side 28.

Figure 11:
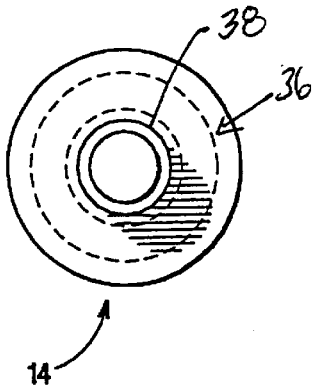
FIGS. 11, 12, and 13 are rear, side, and front views, respectively, of a shaft which is used in both the first and second embodiments shown in FIGS. 1 and 6.
Figure 12:
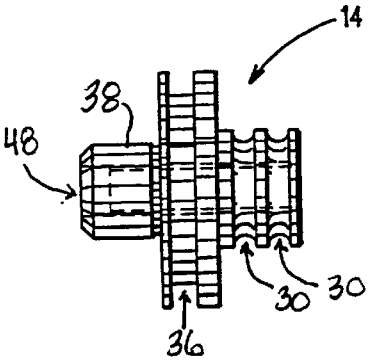
Figure 13:
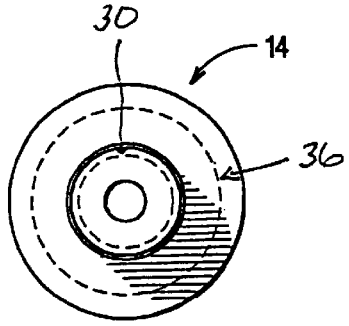

FIGS. 11, 12, and 13 are rear, side, and front views, respectively, of the shaft 14 which is used in both the first and second embodiments shown in FIGS. 1 and 6. The shaft 14 preferably is about 0.610 inch long, and at its widest part, preferably has a diameter of about 0.593 to 0.597 inch. Additional preferred dimensions are shown in the drawings of the provisional application, the contents of which are incorporated herein by reference. While preferred dimensions and shapes are shown, it is understood that the invention is not limited to the preferred dimensions and shapes. Variations from the preferred dimensions and shapes are contemplated and would fall well within the scope of the present invention.

Figure 14:
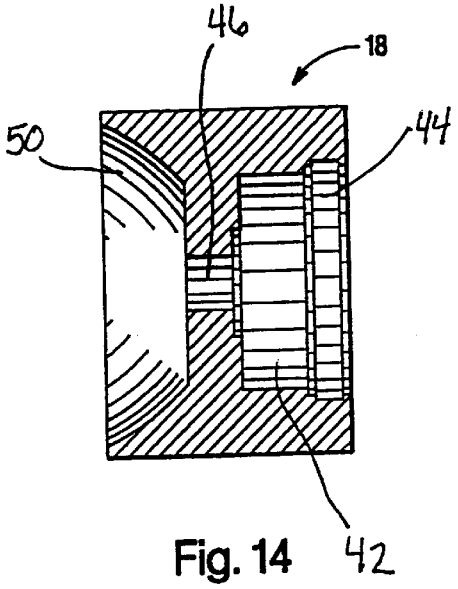
FIGS. 14 and 15 are cross-sectional and front views, respectively, of a rotatable body which is used in the first embodiment shown in FIG. 1.
Figure 15:
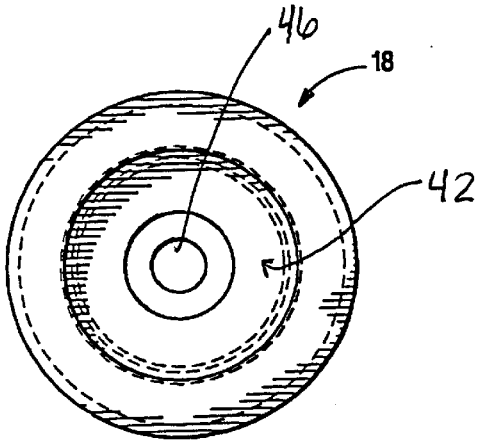

FIGS. 14 and 15 are cross-sectional and front views, respectively, of the rotatable body 18 which is used in the first embodiment shown in FIG. 1. Preferably, the outside diameter of the rotatable body 18 is about 0.875 inch. A preferred length of the rotatable body 18 is about 0.690 inch. Additional preferred dimensions are shown in the drawings of the provisional application, the contents of which are incorporated herein by reference. While preferred dimensions and shapes are shown, it is understood that the invention is not limited to the preferred dimensions and shapes. Variations from the preferred dimensions and shapes are contemplated and would fall well within the scope of the present invention.

Figure 16:
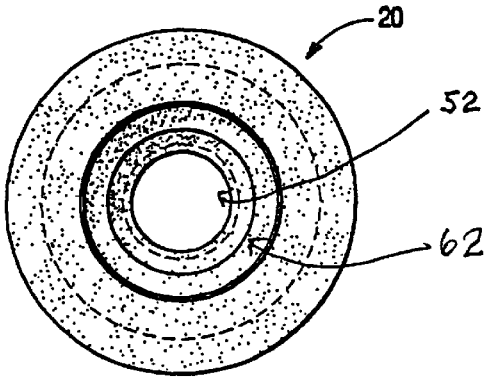
FIGS. 16 and 17 are rear and cross-sectional views, respectively, of a swivel member which is used in the first embodiment shown in FIG. 1.
Figure 17:
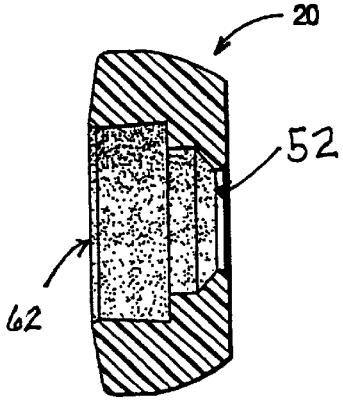

FIGS. 16 and 17 are rear and cross-sectional views, respectively, of the swivel member 20 which is used in the first embodiment shown in FIG. 1. Preferably, the outside diameter of the swivel member 20 is about 0.875 inch. The inside diameter preferably is about 0.482 inch at the entrance to the pad recess 62 and progressively increases at a rate of about 3 degrees. This progressively increasing inside diameter of the pad recess 62 provides an enhanced grip on the shank 60 of the lens pad 24 and more positively maintains a desired position of the shank 60 in the swivel member 20. Preferably, the swivel member 20 has a length of about 0.392 inch. Additional preferred dimensions are shown in the drawings of the provisional application, the contents of which are incorporated herein by reference. While preferred dimensions and shapes are shown, it is understood that the invention is not limited to the preferred dimensions and shapes. Variations from the preferred dimensions and shapes are contemplated and would fall well within the scope of the present invention.

Figure 18:
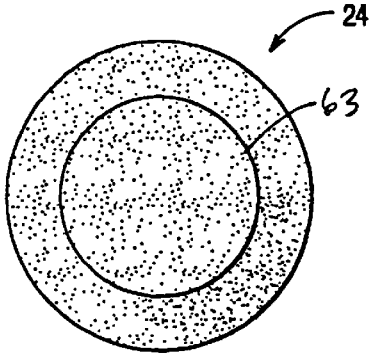
FIGS. 18, 19, and 20 are front, cross-sectional, and rear views, respectively, of a replaceable pad which is used in the first embodiment shown in FIG. 1.
Figure 19:
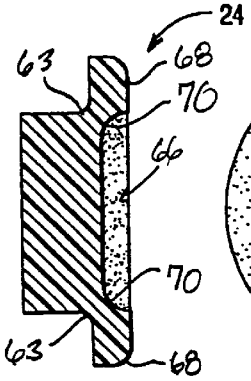
Figure 20:
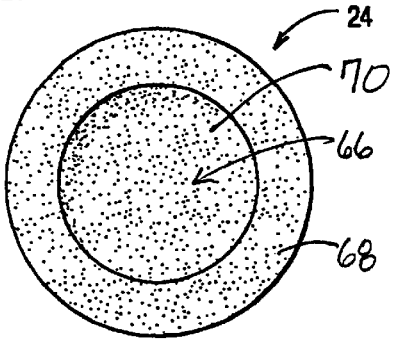

FIGS. 18, 19, and 20 are front, cross-sectional, and rear views, respectively, of the replaceable pad 24 which is used in the first embodiment shown in FIG. 1. Preferably, the head 64 of the pad 24 has an outside diameter of about 0.8 inch, and the shank 60 has an outside diameter of about 0.5 inch. The pad 24 preferably is about 0.325 inch long, with the head 64 accounting for about 0.125 inch of the 0.325 inch length and the shank 60 accounting for the other 0.200 inch of the 0.325 inch length. The recess 66 of the pad 24 preferably is about 0.08 inch deep. Additional preferred dimensions are shown in the drawings of the provisional application, the contents of which are incorporated herein by reference. While preferred dimensions and shapes are shown, it is understood that the invention is not limited to the preferred dimensions and shapes. Variations from the preferred dimensions and shapes are contemplated and would fall well within the scope of the present invention.

Figure 21:
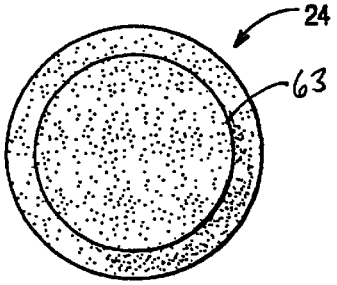
FIGS. 21, 22, and 23 are front, cross-sectional, and rear views, respectively, of a replaceable pad which is used in the second embodiment shown in FIG. 6.
Figure 22:
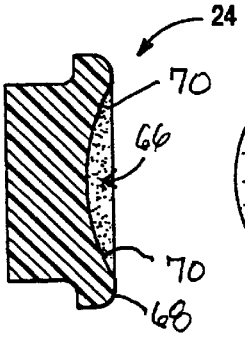
Figure 23:
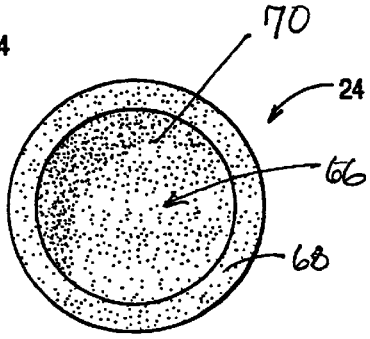

FIGS. 21, 22, and 23 are front, cross-sectional, and rear views, respectively, of the replaceable pad 24 which is used in the second embodiment shown in FIG. 6. Preferably, the pad in FIG. 6 has the same length dimensions as the pad shown in FIG. 1 and the same shank diameter, as well. The outside diameter of the head 64 of the pad 24 in FIGS. 6, 21, 22, and 23, however, is 0.650 inch. Also, the recess 66 of the pad 24 in FIGS. 6 and 21–23 preferably is about 0.067 inch deep at its deepest point. Additional preferred dimensions are shown in the drawings of the provisional application, the contents of which are incorporated herein by reference. While preferred dimensions and shapes are shown, it is understood that the invention is not limited to the preferred dimensions and shapes. Variations from the preferred dimensions and shapes are contemplated and would fall well within the scope of the present invention.

Figure 24:
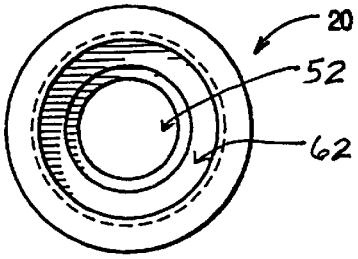
FIGS. 24 and 25 are rear and cross-sectional views, respectively, of a swivel member which is used in the second embodiment shown in FIG. 6.
Figure 25:
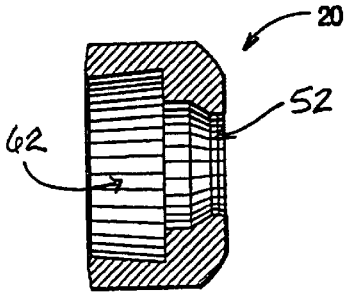

FIGS. 24 and 25 are rear and cross-sectional views, respectively, of the swivel member 20 which is used in the second embodiment shown in FIG. 6. Preferably, the outside diameter of the swivel member 20 in FIGS. 6, 24 and 25 is about 0.65 inch. The inside diameter preferably is about 0.482 inch at the entrance to the pad recess 62 and progressively increases at a rate of about 3 degrees. This progressively increasing inside diameter of the pad recess 62 provides an enhanced grip on the shank 60 of the lens pad 24 and more positively maintains a desired position of the shank 60 in the swivel member 20. Preferably, the swivel member 20 has a length of about 0.392 inch (i.e. the same length as that of the swivel member 20 in FIG. 1). Additional preferred dimensions are shown in the drawings of the provisional application, the contents of which are incorporated herein by reference. While preferred dimensions and shapes are shown, it is understood that the invention is not limited to the preferred dimensions and shapes. Variations from the preferred dimensions and shapes are contemplated and would fall well within the scope of the present invention.

Figure 26:
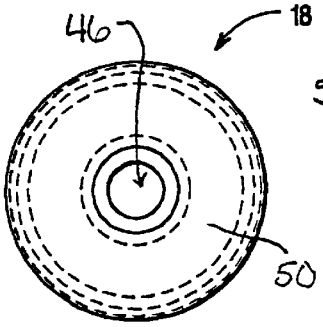
FIGS. 26, 27, and 28 are rear, cross-sectional, and front views, respectively, of a rotatable body which is used in the second embodiment shown in FIG. 6.
Figure 27:
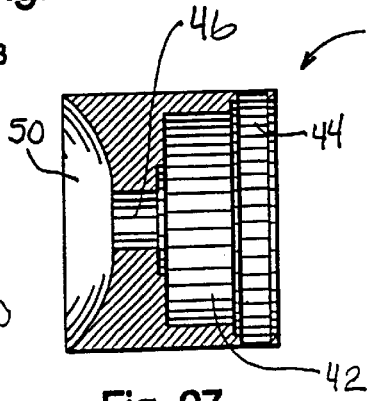
Figure 28:
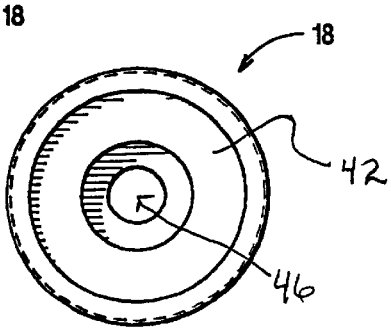

FIGS. 26, 27, and 28 are rear, cross-sectional, and front views, respectively, of the rotatable body 18 which is used in the second embodiment shown in FIG. 6. Preferably, the outside diameter of the rotatable body 18 in FIGS. 6 and 26–28 is about 0.65 inch. A preferred length of the rotatable body 18 is about 0.6 inch. Additional preferred dimensions are shown in the drawings of the provisional application, the contents of which are incorporated herein by reference. While preferred dimensions and shapes are shown, it is understood that the invention is not limited to the preferred dimensions and shapes. Variations from the preferred dimensions and shapes are contemplated and would fall well within the scope of the present invention.

The illustrated embodiments achieved several advantages over conventional clamp pads. The ability to quickly replace lens clamp pad assemblies provides increased versatility and manufacturing efficiencies. One such efficiency is realized by a reduction in the downtime which is usually required to replace a worn or otherwise inappropriate clamp pad and/or related assembly.

While the advantages of the present invention typically will be maximized by combining all of the advantageous aspects described above, it is understood that individual aspects can be used without the various other advantageous aspects. The quick-release arrangement, for example, can be used with pads which lack the recess 66. The quick-release arrangement also can be used to facilitate changes from assemblies which carry the pads with the recess 66 to those which carry the pads without the recess, when the recess is not needed (e.g., when fragile coatings are not applied to the lenses), and vice versa when the recess is needed. The quick-release arrangement also can be used, with or without the other advantageous aspects of the invention, to facilitate quick switching between lens pad assemblies having lens pads of different sizes. This, in turn, permits rapid adaptation of lens processing devices to accommodate lenses having different sizes.

Likewise, the pads 24 with the recess 66 can be provided on a clamp pad assembly which does not include a quick-release arrangement. The removability of the pad 24 from the swivel member 18 also can be provided with or without the quick-release arrangement and/or counterbored pads 24.

While the present invention has been described with reference to preferred embodiments, it is understood that the invention is not limited to the illustrated and described features. To the contrary, the invention is capable of further modifications, usages, and/or adaptations following the general principles of the invention and therefore includes such departures from the present disclosure as come within known or customary practice in the art to which the invention pertains, and as may be applied to the central features set forth above, and which fall within the scope of the appended claims.

What is claimed is:

1. A clamp pad assembly comprising:

a lens pad; and a rotatable body for rotatably connecting the lens pad, at least indirectly, to a clamp arm, said lens pad comprising a lens-engaging surface, said lens-engaging surface having a lens-facing recess located substantially centrally on the lens-engaging surface.

2. The clamp pad assembly of claim 1, wherein said lens pad further comprises a shank and a head, said lens-engaging surface being disposed on said head, said head being at least partially hollowed to define said lens-facing recess.

3. The clamp pad assembly of claim 2, wherein said lens-facing recess is disposed substantially centrally in the lens-engaging surface on the head.

4. The clamp pad assembly of claim 2, wherein said rotatable body presents a pad recess to said lens pad, said shank being shaped to facilitate insertion of the shank into said pad recess, frictional retention therein, and removal of the shank out from the pad recess if the lens pad becomes excessively worn.

5. The clamp pad assembly of claim 4, further comprising a swivel member connected pivotally to said rotatable body, whereby compensation for asymmetric lenses is provided by pivoting of the swivel member and of said lens pad with respect to said rotatable body during rotation of said rotatable body, said pad recess being defined in said swivel member.

6. The clamp pad assembly of claim 1, further comprising a swivel member connected pivotally to said rotatable body, said lens pad being mounted to said swivel member, whereby compensation for asymmetric lenses is provided by pivoting of the swivel member and of said lens pad with respect to said rotatable body during rotation of said rotatable body.

7. The clamp pad assembly of claim 6, wherein said rotatable body is connected to a quick-release system capable of frictionally connecting said rotatable body to said clamp arm.

8. The clamp pad assembly of claim 7, wherein said quick-release system includes:

a shaft connected to said rotatable body, said rotatable body being mounted to said shaft for rotation with respect thereto, said shaft having at least one circumferential O-ring groove; and an O-ring disposed in each of said at least one O-ring groove, said O-ring being resilient such that insertion of said shaft into an opening in said clamp arm causes compression of said O-ring and frictional retention of said shaft in said opening, said frictional retention being selectively over-ridable to release said shaft from said clamp arm.

9. The clamp pad assembly of claim 1, wherein said rotatable body is connected to a quick-release system capable of frictionally connecting said rotatable body to said clamp arm.

10. The clamp pad assembly of claim 9, wherein said quick-release system includes:

a shaft connected to said rotatable body, said rotatable body being mounted to said shaft for rotation with respect thereto, said shaft having at least one circumferential O-ring groove; and an O-ring disposed in each of said at least one O-ring groove, said O-ring being resilient such that insertion of said shaft into an opening in said clamp arm causes compression of said O-ring and frictional retention of said shaft in said opening, said frictional retention being selectively over-ridable to release said shaft from said clamp arm.

11. The clamp pad assembly of claim 1, wherein said lens-engaging surface is made of a resilient material to avoid damage to lenses and coatings thereof.

12. A clamp pad assembly comprising:

a lens pad; and a rotatable body for rotatably connecting the lens pad, at least indirectly, to a clamp arm, said lens pad comprising a lens-engaging surface which is more resilient toward a center thereof than toward a periphery thereof.

13. The clamp pad assembly of claim 12, wherein said lens pad further comprises a shank and a head, said lens-engaging surface being disposed on said head.

14. The clamp pad assembly of claim 13, wherein said rotatable body presents a pad recess to said lens pad, said shank being shaped to facilitate insertion of the shank into said pad recess, frictional retention therein, and removal of the shank out from the pad recess if the lens pad becomes excessively worn.

15. The clamp pad assembly of claim 14, further comprising a swivel member connected pivotally to said rotatable body, whereby compensation for asymmetric lenses is provided by pivoting of the swivel member and of said lens pad with respect to said rotatable body during rotation of said rotatable body, said pad recess being defined in said swivel member.

16. The clamp pad assembly of claim 12, further comprising a swivel member connected pivotally to said rotatable body, said lens pad being mounted to said swivel member, whereby compensation for asymmetric lenses is provided by pivoting of the swivel member and of said lens pad with respect to said rotatable body during rotation of said rotatable body.

17. The clamp pad assembly of claim 16, wherein said rotatable body is connected to a quick-release system capable of frictionally connecting said rotatable body to said clamp arm.

18. The clamp pad assembly of claim 17, wherein said quick-release system includes:

a shaft connected to said rotatable body, said rotatable body being mounted to said shaft for rotation with respect thereto, said shaft having at least one circumferential O-ring groove; and an O-ring disposed in each of said at least one O-ring groove, said O-ring being resilient such that insertion of said shaft into an opening in said clamp arm causes compression of said O-ring and frictional retention of said shaft in said opening, said frictional retention being selectively over-ridable to release said shaft from said clamp arm.

19. The clamp pad assembly of claim 12, wherein said rotatable body is connected to a quick-release system capable of frictionally connecting said rotatable body to said clamp arm.

20. The clamp pad assembly of claim 19, wherein said quick-release system includes:

a shaft connected to said rotatable body, said rotatable body being mounted to said shaft for rotation with respect thereto, said shaft having at least one circumferential O-ring groove; and an O-ring disposed in each of said at least one O-ring groove, said O-ring being resilient such that insertion of said shaft into an opening in said clamp arm causes compression of said O-ring and frictional retention of said shaft in said opening, said frictional retention being selectively over-ridable to release said shaft from said clamp arm.

21. A clamp pad assembly comprising:

a lens pad;

a rotatable body for rotatably connecting the lens pad, at least indirectly, to a clamp arm; and a swivel member pivotally mounted to the rotatable body for rotation therewith and for pivoting with respect thereto, said lens pad being mounted to said swivel member for rotation and pivoting therewith.

22. The clamp pad assembly of claim 21, wherein said lens pad comprises a shank, a head, and a lens-engaging surface disposed on said head.

23. The clamp pad assembly of claim 22, wherein said swivel member presents a pad recess to said lens pad, said shank being shaped to facilitate insertion of the shank into said pad recess, frictional retention therein, and removal of the shank out from the pad recess if the lens pad becomes excessively worn.

24. The clamp pad assembly of claim 21, wherein said rotatable body is connected to a quick-release system capable of frictionally connecting said rotatable body to said clamp arm.

25. The clamp pad assembly of claim 24, wherein said quick-release system includes:

a shaft connected to said rotatable body, said rotatable body being mounted to said shaft for rotation with respect thereto, said shaft having at least one circumferential O-ring groove; and an O-ring disposed in each of said at least one O-ring groove, said O-ring being resilient such that insertion of said shaft into an opening in said clamp arm causes compression of said O-ring and frictional retention of said shaft in said opening, said frictional retention being selectively over-ridable to release said shaft from said clamp arm.

26. A clamp pad assembly comprising:

a lens pad;

a rotatable body for rotatably connecting the lens pad, at least indirectly, to a clamp arm; and a quick-release system capable of frictionally connecting said rotatable body to said clamp arm.

27. The clamp pad assembly of claim 26, wherein said quick-release system includes:

a shaft connected to said rotatable body, said rotatable body being mounted to said shaft for rotation with respect thereto, said shaft having at least one circumferential O-ring groove; and an O-ring disposed in each of said at least one O-ring groove, said O-ring being resilient such that insertion of said shaft into an opening in said clamp arm causes compression of said O-ring and frictional retention of said shaft in said opening, said frictional retention being selectively over-ridable to release said shaft from said clamp arm.

28. The clamp pad assembly of claim 27, wherein said lens pad further comprises a shank, a head, and a lens-engaging surface disposed on said head.

29. The clamp pad assembly of claim 28, wherein said rotatable body presents a pad recess to said lens pad, said shank being shaped to facilitate insertion of the shank into said pad recess, frictional retention therein, and removal of the shank out from the pad recess if the lens pad becomes excessively worn.

30. The clamp pad assembly of claim 26, wherein said lens pad further comprises a shank, a head, and a lens-engaging surface disposed on said head.

31. The clamp pad assembly of claim 30, wherein said rotatable body presents a pad recess to said lens pad, said shank being shaped to facilitate insertion of said shank into said pad recess, frictional retention therein, and removal of the shank out from the pad recess if the lens pad becomes excessively worn.

32. A clamp pad assembly comprising:

a shaft having first and second portions spaced longitudinally along the shaft, said first portion having at least one circumferential O-ring groove;

an O-ring in each of said at least one O-ring groove, said O-ring being resilient so that insertion of said first portion into a clamp arm opening causes compression of said O-ring and over-ridable frictional retention of the first portion of the shaft in the opening of the clamp arm;

a bearing located against the second portion of the shaft;

a rotatable body mounted to the bearing for rotation with respect to the shaft;

a swivel member pivotally mounted to the rotatable body for rotation therewith and for pivoting with respect thereto; and a lens pad mounted to said swivel member for rotation and pivoting with the swivel member.

33. The clamp pad assembly of claim 32, wherein said lens pad includes an annularly shaped lens-engaging surface and a lens-facing recess located substantially centrally on the lens-engaging surface.

34. The clamp pad assembly of claim 32, wherein said lens pad includes a lens-engaging surface which is more resilient toward a center thereof than toward a periphery thereof.

* * * * *